US005301653A

United States Patent [19]

Gerdes et al.

[11] Patent Number: 5,301,653

[45] Date of Patent: Apr. 12, 1994

[54] GAS RANGE HAVING DOWN DRAFT WITH AUTOMATIC SHUTOFF DURING IGNITION

[75] Inventors: Michael D. Gerdes; Richard T. Jahr; William E. Nothe; Calvin J. Thomas; Richard A. Wrege, all of Florence, S.C.

[73] Assignee: Caloric Corporation, Florence, S.C.

[21] Appl. No.: 7,922

[22] Filed: Jan. 25, 1993

[51] Int. Cl.[5] ..... F24C 3/00

[52] U.S. Cl. ..... 126/39 E; 126/39 G; 126/39 R

[58] Field of Search ..... 126/39 G, 39 R, 39 BA, 126/41 R, 39 E, 25 B; 431/43, 44–46

[56] References Cited

U.S. PATENT DOCUMENTS 4,413,610 11/1983 Berlik ..... 126/39 R X 4,891,004 1/1990 Ballard et al. ..... 431/6

*Primary Examiner*—Larry Jones

*Attorney, Agent, or Firm*—William R. Clark; Richard M. Sharkansky

[57] ABSTRACT

A gas surface range having a downdraft ventilation system with automatic shut off during ignition. A relay is activated by current flowing to the spark coil of the electrical igniter, and has contacts connected in series with the blower motor of the downdraft system. Thus, the downdraft system is disabled during attempted ignition, and is automatically enabled at the completion of ignition.

14 Claims, 4 Drawing Sheets

GAS RANGE HAVING DOWN DRAFT WITH AUTOMATIC SHUTOFF DURING IGNITION

BACKGROUND OF THE INVENTION

The invention generally relates to gas cooking ranges, and more particularly relates to gas surface ranges that have electrical igniters and a down draft ventilation system.

As is well known, gas surface ranges have been built with down draft ventilation systems. One such example is described in U.S. Pat No. 4,413,610 which issued Nov. 8, 1983. In particular, the range described therein had a cooktop surface with two compartments each of which received a modular plug-in cartridge. One type of cartridge had two surface burners, and the other type included tubular burners in a broiler or grill unit. Each burner of the surface burner cartridge had side jump ports which were adjacent to respective flash tubes that extended horizontally towards a common igniter. When the control knob for either of the two surface burners was turned to the light position, the conductor of the igniter was energized by a high voltage such as 15,000 to 20,000 volts. As a result, an electrical arc jumped from the conductor to a target which was grounded to the frame. Gas from the burner ignition ports which had filled the flash tube was ignited and burned back to the jump ports that carried the flame upwards to light the burner.

The surface range further had a down draft ventilation or exhaust system located in a central region of the cooktop surface between the two compartments that received the plug-in cartridges. The down draft exhaust system included a blower connected to and communicating with a duct having an inlet or mouth defined by an aperture in the cooktop surface. In operation, the blower drew air across the cooktop surface past the cartridges and down into the duct through the aperture. In such manner, cooking effluents such as smoke were drawn from the cooking area. The blower was actuated either by manually turning a control knob, or automatically in response to a grill cartridge being operated.

The American Gas Association requires that surface gas ranges with down draft ventilation systems pass a specified ignition test. In particular, ignition must be attained within four seconds under certain operating conditions. The first condition is that the down draft be set at high speed. The second condition is that the gas pressure be reduced to 3.5 inches water column. The third condition is that a pot be placed on each of the surface burners, presumably thereby increasing the velocity of the air flow in the area of the igniter. Under the AGA test conditions described above, ignition may fail to occur within four seconds if operated with a down draft blower of relatively large capacity such as, for example 400 cubic feet per minute. More specifically, the relatively strong draft at the burner and through the igniter and flash tube region may prevent the proper gas/air mixture for ignition.

SUMMARY OF THE INVENTION

In accordance with the invention, a gas fueled appliance comprises a gas burner with an electrical igniter and means for actuating the igniter. The appliance further has exhaust means for forcing a flow of air past the gas burner to remove cooking effluents. Also, means responsive to actuation of the igniter is provided for disabling the exhaust means. The invention has particular advantage with an appliance where the exhaust means comprises a duct extending downwardly from approximately the same level as the burner and a blower coupled to the duct draws air past the burner and down into the duct. It is preferable that the disabling means comprise a relay in series with the blower, and that the relay be activated in response to the igniter actuating means. In an advantageous embodiment, the burner is a surface burner and is mounted in a plug-in cartridge that also includes a second gas surface burner. The appliance may also include a plurality of compartments each adapted to receive a respective one of the plug-in cartridges, and means responsive to operation of one of the burners for activating the exhaust means.

With such arrangement, the exhaust means is automatically disabled during ignition of gas burners. Therefore, with a system such as a down draft ventilation system that creates a relatively strong flow of air across the cooktop surface, the air flow is temporarily interrupted to avoid interference with the ignition process. That is, for the time period that a burner control knob is in the light or ignition position, the exhaust means is shut off if it is on. Then, when the control knob is moved to a burn position, the exhaust means is automatically enabled. Therefore, the appliance can pass the AGA ignition test with the exhaust blower or fan set to high, the gas line set to a relatively low specified pressure, and a pot on each burner.

In accordance with another feature of the invention, a gas surface range comprises a cooktop surface having at least one surface gas fueled burner mounted in an opening therein. An electrical igniter is disposed proximate the gas burner, and means are provided for supplying a flow of electrical current to the igniter. Further, a down draft duct is provided with an air inlet disposed adjacent the gas fueled burner at substantially the same level as the cooktop. A blower is coupled to the duct and is operable to draw air across the cooktop surface and down the duct to remove cooking effluents from the region of the range. Also, the range includes means responsive to current flowing to the igniter for deactivating or disabling the blower. It is preferable that the disabling means comprise a relay in series with a switch for the igniter, and operative to open a switch in series with the blower.

With such arrangement, the blower is automatically turned off when ignition of the surface burner is initiated. Thus, proper gas/air mixture is not interrupted by the flow of air past the region of the igniter and flash tube. More specifically, in the situation where the down draft blower is already operating because another burner is active or the operator has turned on the blower, turning of a gas control knob to the light position will automatically disable or deactivate the blower to eliminate the relatively strong flow of air across the cooktop. Further, once ignition is completed and current flow to the igniter is terminated, the down draft blower automatically comes back on.

BRIEF DESCRIPTION OF THE DRAWINGS

The foregoing objects and advantages will be more fully understood by reading the following description of the preferred embodiment with reference to the drawings wherein.

DESCRIPTION OF THE PREFERRED EMBODIMENT

Figure 1:
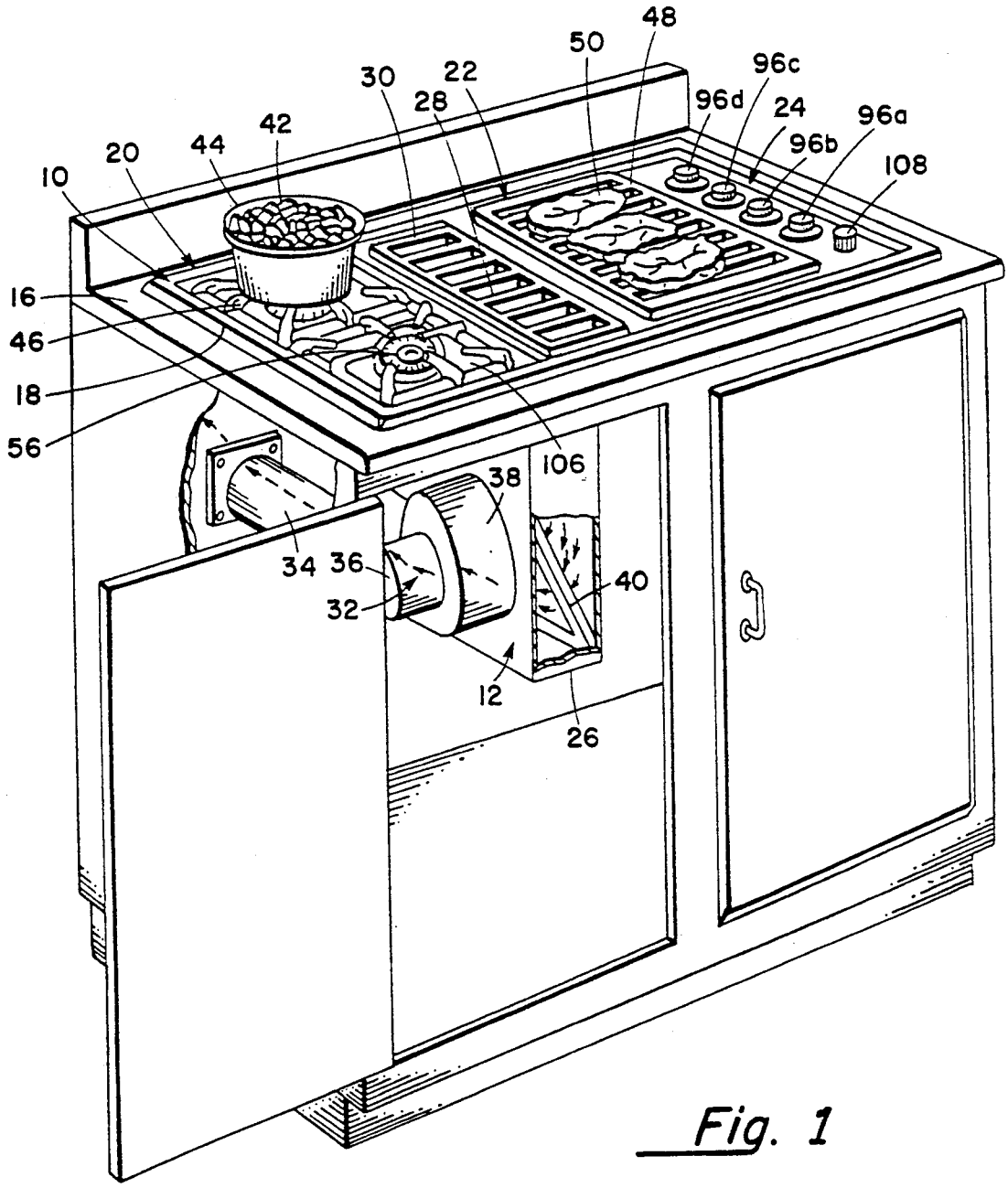
FIG. 1 is a perspective view of a gas surface range having a centrally located down draft ventilation or exhaust system.

Referring to FIG. 1, a gas surface range 10 with a down draft ventilation or exhaust system 12 is shown. Although gas surface range 10 is here depicted as a countertop built-in unit, range 10 may also be used to advantage in other types of configurations such as a free standing unit. As a countertop built-in unit, range 10 is installed by lowering it through a large opening 14 (FIG. 3) in countertop 16 until outwardly extending perimeter lip 18 contacts the region of the countertop 16 adjacent to the opening 14 thereby providing support for range 10.

Figure 2:
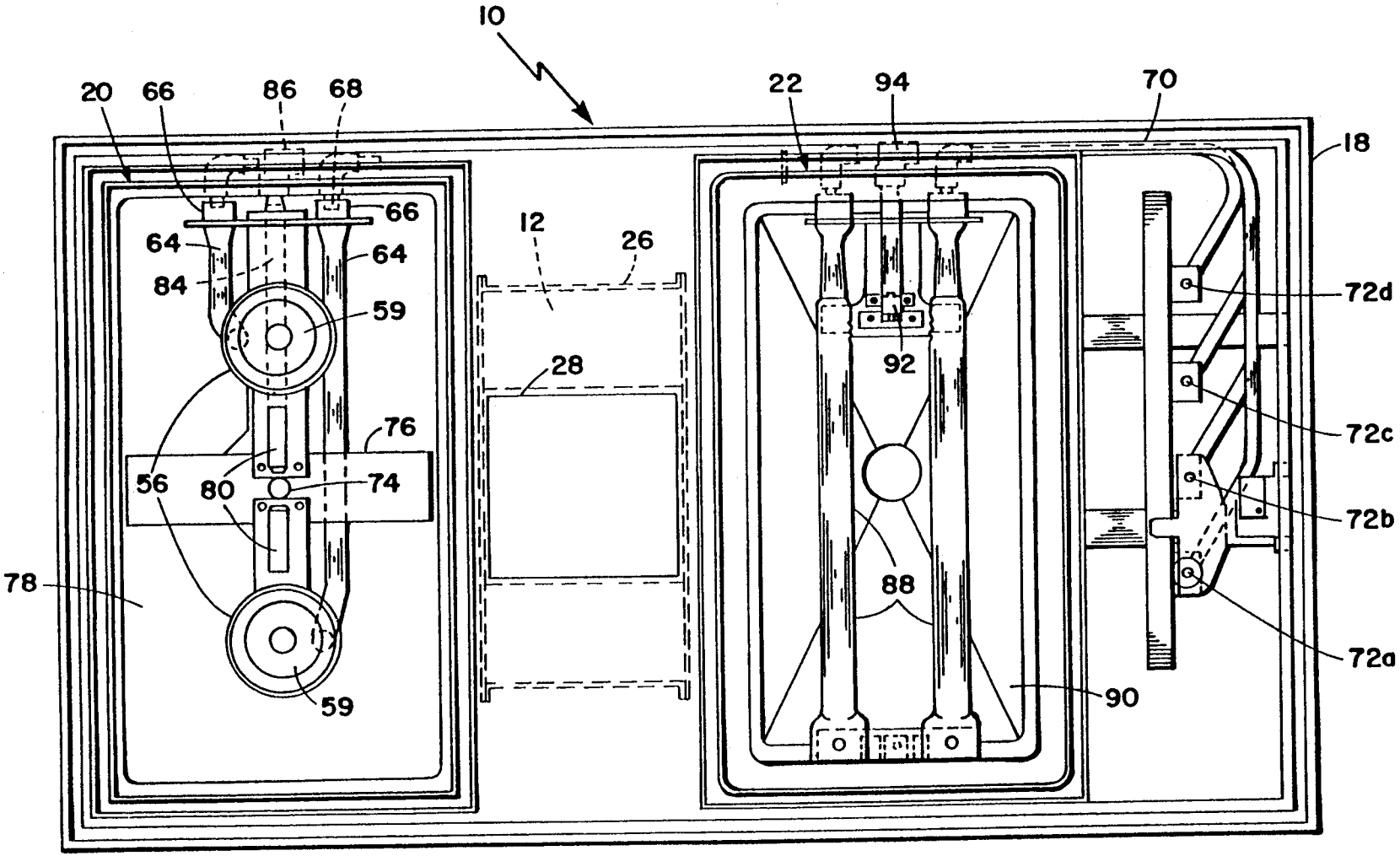
FIG. 2 is a top view of the range with top surface and control panels removed.

Also referring to FIG. 2, gas surface range 10 is here shown with two plug-in cooking cartridges 20 and 22 disposed on opposite lateral sides of down draft ventilation system 12, and a control panel 24 located at one lateral edge. Down draft ventilation system 12 has a downwardly extending duct 26 that has a top central opening or air inlet 28. As shown in FIG. 1. air inlet 28 to duct 26 is covered by grate 30. A blower 32 is connected to a lower portion of duct 26, and communicates with exhaust pipe 34 that typically leads outside the dwelling. Blower 32 includes a motor 36 and a fan or propeller section 38. A filter 40 is positioned within duct 26, and if the exhaust is to be recycled within the dwelling, further filtering apparatus is generally required. Gas surface burner cartridge 20 is conventionally used to cook food 42 contained in a utensil such as pan 44. Grates 46 are used to support pans 44. Grill cartridge 22 has a top grill which is typically used to directly support food such as steaks 50. Fats and juices emanating from heated foods 50 drip on hot surfaces below where they vaporize and rise past the food 50 to give a char-flavor taste that is preferred by many. As is well known, down draft ventilation system 12 functions to draw cooking effluents such as smoke and grease down into duct 26.

Figure 3:
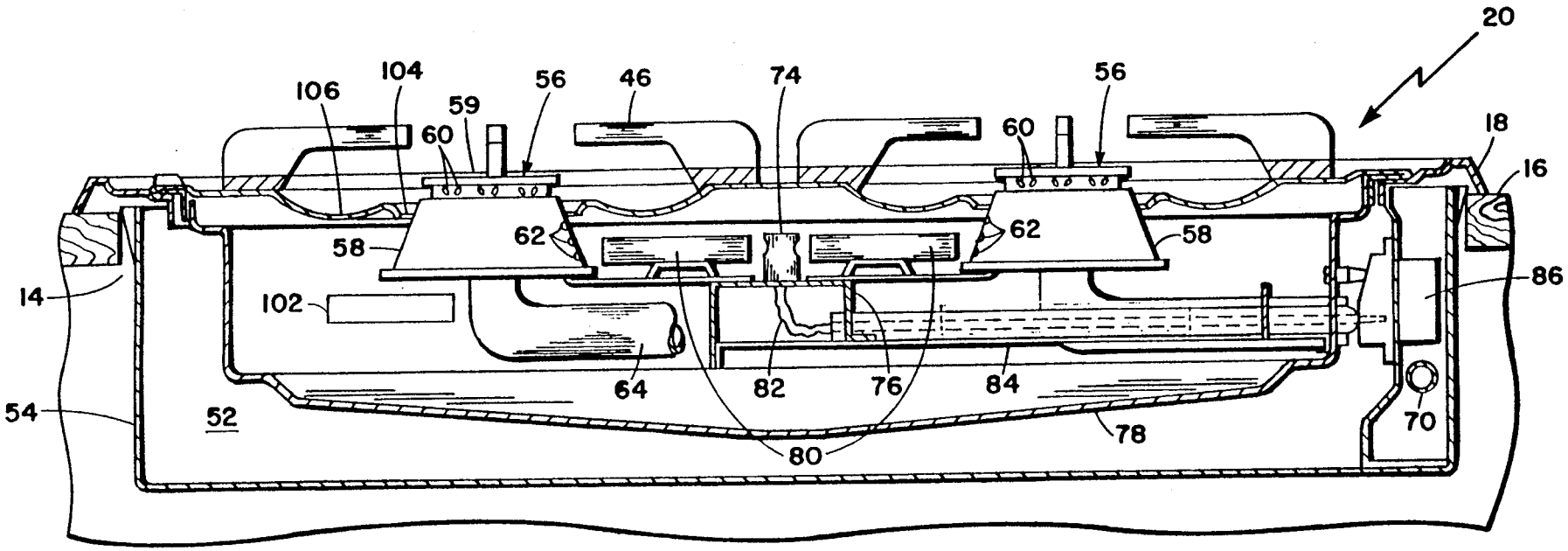
FIG. 3 is a partially sectioned side view of a plug-in cartridge including two gas surface burners and a common igniter with flash tubes.

Also referring to FIG. 3, plug-in surface burner cartridge 20 like grill cartridge 22 is received in a compartment 52 bounded by burner box 54. As is described in detail in U.S. Pat. No. 4,413,610 which is hereby incorporated by reference, cartridges 20 and 22 are removable. Accordingly, the surface configuration of range 10 may easily be altered. For example, grill cartridge 22 can be removed and stored while a surface burner cartridge 20 is replaced into its compartment 52. In such configuration, range 10 would have two surface burner cartridges. Still referring to FIG. 3, surface burner cartridge 20 has front and back gas fueled surface burners 56 each of which has a body or head 58 and a cap 59. A plurality of burner ports 60 are horizontally disposed at the upper end of the head 58, and jump ports 62 are vertically disposed down respective facing sides of heads 58. As shown best in FIG. 2, each burner 56 is adapted to receive gaseous fuel from a venturi tube 64 that may have an adjustable mixer head 66. The venturi tube 64 is held in fixed alignment with the orifice hood 68 which receives gaseous fuel from an individual gas pipe 70 running from a corresponding valve 72*a–d*.

A conventional electrical igniter 74 is mounted to a bracket 76 that is mounted to pan 78 that encloses the under side of cartridge 20. Also, conventional hollow flash tubes 80 are mounted to bracket 76, and each flash tube 80 extends from a location immediately adjacent igniter 74 to a location immediately adjacent to jump ports 62 of a respective burner 56. Electrical wires 82 run from igniter 74 through conduit 84 to an electrical connector 86 at the rear of cartridge 20. As described in detail in U.S. Pat. No. 4,413,610, suitable apparatus including connector 86 is provided for coupling venturi tubes 64 and wires 82 through a disengagable junction at the rear of cartridge 20 to control panel 24. It should also be understood that invention could be practiced to advantage with a fixed gas surface range that has burners mounted to a cooktop that is permanently mounted instead of being removable as a plug-in cartridge. Further, the invention would have advantages in a range having sealed gas burners.

Briefly, cartridge 22 is here shown with two elongated tubular side ported burners 88 that are positioned in pan 90 with grill 48 disposed thereover. An igniter 92 is mounted to pan 90. Similar to cartridge 20, cartridge 22 has a corresponding connector 94 for removably coupling igniter 92 to control panel 24. Further, as described above, a fixed unit could be used instead of a plug-in unit.

In operation, when a burner 56 or 88 is to be ignited, the corresponding control knob 96*a–d* on control panel 24 is manually turned to the light position. In response thereto, the corresponding gas valve 72*a–d* is opened to supply fuel to the respective burner, and a switch 100*a–d* (FIG. 4) is closed to provide a flow of current to igniter 74 and 92. In conventional manner, a high voltage such as 15,000 to 20,000 volts is produced, and an electrical arc jumps from the igniter conductor to a target which is grounded. In the case of surface burner cartridge 20, the arc ignites gas which has issued from jump ports 62 and filled flash tube 80. The gas burns back the flash tube 80 and is carried up the jump ports 62 to ignite gas issuing from ports 60. In such manner, burners 56 are conventionally lighted. The corresponding control knob 96*a–d* is then moved to the desired steady state setting. Under steady state operation, primary and secondary combustion air is drawn into cartridge 20 through side vents 102. The primary combustion air is introduced into venturi tubes 64, and the secondary combustion air flows up along burner heads 58 through openings 104 in cartridge cover or cooktop surface 106.

Blower 32 can be manually activated by control knob 108. Further, as described in U.S. Pat. No. 4,413,610, blower 32 is automatically activated when burners 88 of grill cartridge 22 are operating. In operation, blower 32 draws a large volume of air such as, for example 400 cubic feet per minute, down duct 26 for exhaust out exhaust pipe 34. In response thereto, a strong flow of air is drawn across cooktop surface 106 past burners 56, and also a flow of air is forced through vents 102 past igniter 74 and flash tubes 80.

Figure 4:
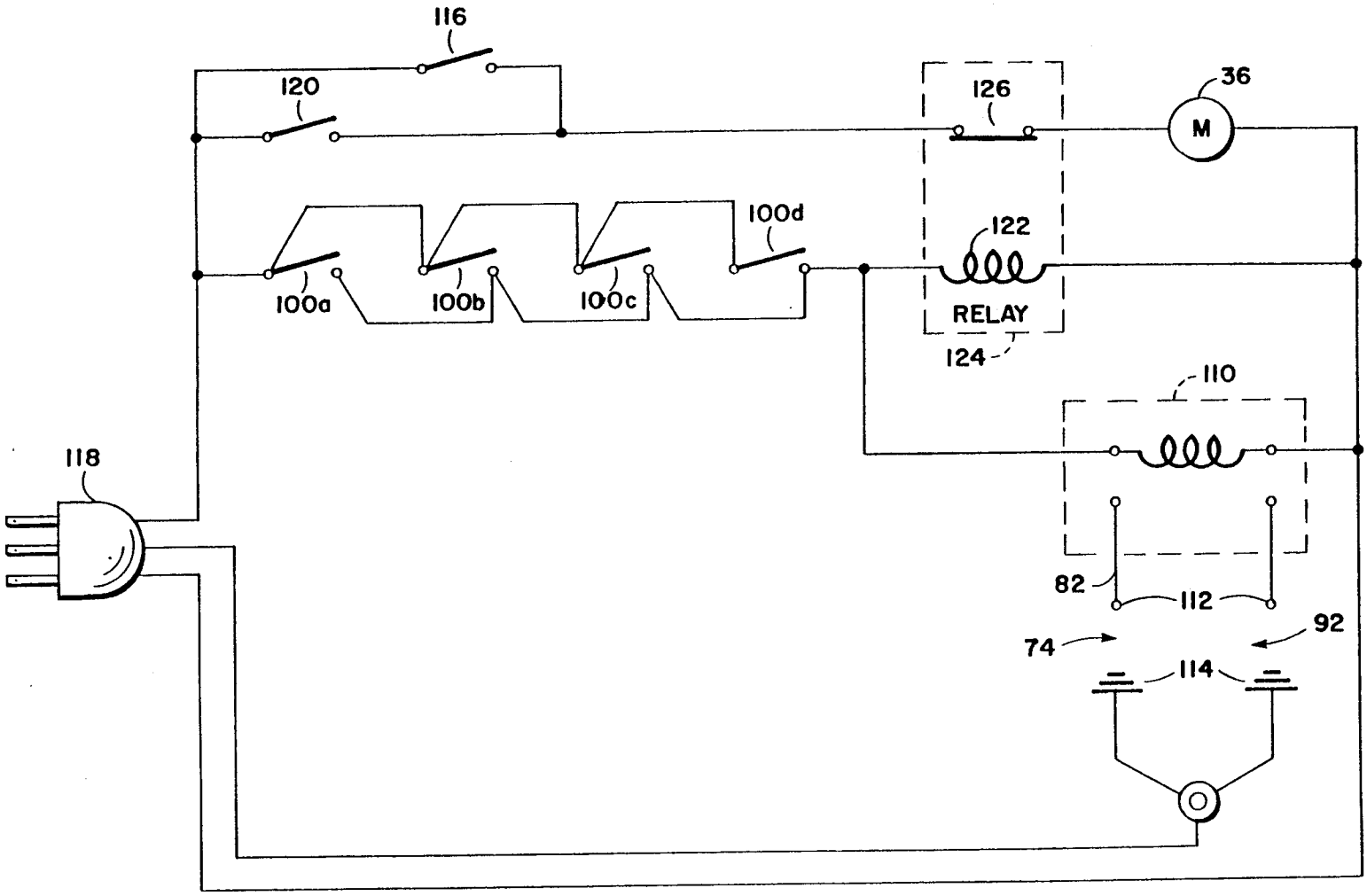
FIG. 4 is a simplified electrical schematic of the range.

Referring to FIG. 4, a simplified electrical schematic of range 10 is shown. Conventional pilotless ignition switches 100*a–d* are connected to respective gas valves 72*a–d*, and the turning of any one of them to the light or ignition position causes conventional spark module 110 to be activated resulting in high voltage such as 20,000 to 40,000 volts being provided to both igniters 74 and 92. In particular, conductors 112 are raised to the high voltage through wires 82, and electrical arcs jump to targets 114 which are grounded.

Switch 116 is controlled by control knob 108 on control panel 24 and can be used to manually activate motor 36 of blower 32 by closing the circuit to AC receptacle plug 118. Further than having the down draft ventilation system 12 activated by option of the operator, it is desirable to provide an interlock such that it is activated any time the grill of cartridge 22 is operating. As described in detail in U.S. Pat No. 4,413,610, switch 120 is mechanically coupled such that it is closed any time either gas valve 72*c* or *d* is open to feed gas to cartridge 22. Thus, motor 36 of blower 32 is activated by operator selection or if grill cartridge 22 is being used.

In accordance with the invention, coil 122 of relay 124 is connected in parallel with spark module 110. Therefore, anytime one of switches 100*a–d* is closed by turning the corresponding control knob 96*a–d* to the ignition or light position, current flows through coil 122 which functions to open the normally closed contacts of switch 126 of relay 124. Thus, even if blower 32 were active by either operator selection or the operation grill cartridge 22, the process of attempting to light burners 56 automatically deactivates or disables blower 32. As a consequence, there never is a forced flow of air across cooktop surface 106 past burners 56 during an ignition process. Further, there is no forced flow of air through vents 102 past igniter 74 and flash tubes 80 during ignition. Therefore, the down draft ventilation system 12 does not interfere with or interrupt the proper gas/fuel mixture for ignition of surface burners 56 or burners 88. During AGA testing, the blower can be set for high speed with the gas pressure at 3.5 inches water column and a pot on each burner 56, and ignition will occur in a normal manner within four seconds. Further, the velocity of the air flow is not a factor because the flow of air is temporarily interrupted. Also, after ignition when the control knob 96*a–d* is turned from the light position to a steady state burn position, corresponding switch 100*a–d* opens so relay 82 is automatically deactivated and switch 126 closes thereby enabling motor 36. Therefore, assuming that motor 36 was operating before ignition, motor 36 of blower 32 automatically starts again after the ignition process is completed.

This concludes the description of the preferred embodiment. However, a reading of it by one skilled in the art will bring to mind many alterations and modifications that do not depart from the spirit and scope of the invention. Therefore, it is intended that the scope of the invention will be limited only by the appended claims.

What is claimed is:

1. A gas fueled appliance comprising:

a gas burner;

an electrical igniter for igniting said gas burner;

means for actuating said electrical igniter;

exhaust means for forcing a flow of air past said gas burner to remove cooking effluents; and means responsive to actuation of said igniter for disabling said exhaust means.

2. The appliance recited in claim 1 wherein said exhaust means comprises a duct extending downwardly from approximately the same level as said burner and a blower coupled to said duct for drawing air past said burner and down into said duct.

3. The appliance recited in claim 2 wherein said disabling means comprises relay contacts in series with said blower, said relay being activated in response to said igniter actuating means.

4. The appliance recited in claim 2 wherein said burner is a surface burner.

5. The appliance recited in claim 4 wherein said gas burner is mounted in a plug-in cartridge further comprising a second gas surface burner.

6. The appliance recited in claim 5 further comprising a plurality of compartments each adapted to receive a respective one of said plug-in cartridges.

7. The appliance recited in claim 6 further comprising means responsive to operation of one of said burners for activating said exhaust means.

8. A gas surface range comprising:

a cooktop surface;

at least one surface gas fueled burner mounted in an opening in said cooktop surface;

an electrical igniter for igniting said gas fueled burner;

means for supplying a flow of electrical current to said igniter to actuate said igniter;

a down draft duct having an air inlet disposed adjacent to said gas fueled burner at substantially the same level as said cooktop surface;

a blower coupled to said duct and operable to draw air across said cooktop surface and down into said duct to remove cooking effluents from the region of said range; and a switch connected in series with said blower and responsive to current flowing to said igniter to disable said blower during igniting of said gas fueled burner.

9. The range recited in claim 8 wherein said cooktop surface and said gas fueled burner are part of a plug-in cartridge further comprising a second gas fueled burner.

10. The gas surface range recited in claim 9 further comprising a plug-in grill cartridge.

11. The gas surface range recited in claim 10 further comprising means for activating said blower in response to operation of said grill cartridge.

12. The gas surface range recited in claim 10 further comprising means for manually activating said blower.

13. In a gas surface range having a down draft ventilator adapted for drawing air across a cooktop surface of the range past a burner and a corresponding electrical igniter to a duct having an intake adjacent the cooktop, a method comprising the steps of:

activating the ventilator to draw the air; and disabling the ventilator in response to actuation of said igniter.

14. The method recited in claim 13 wherein said disabling step comprises the step of interrupting power to said ventilator in response to current flowing to said igniter.

* * * * *